US006121898A

United States Patent [19]

Moetteli

[11] Patent Number: 6,121,898

[45] **Date of Patent: *Sep. 19, 2000**

[54] TRAFFIC LAW ENFORCEMENT SYSTEM

[76] Inventor: John B. Moetteli, 14, Ave. Ernest-Pictet, CH-1203 Geneva, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/047,272

[22] Filed: Mar. 24, 1998

Related U.S. Application Data

[63] Continuation-in-part of application No. PCT/US97/18871, Oct. 28, 1997.

[51] Int. Cl.[7] ..... G08G 1/01

[52] U.S. Cl. ..... 340/933; 340/936; 340/905; 348/149

[58] Field of Search ..... 340/933, 936, 340/942, 937, 905; 348/149; 701/119

[56] References Cited

U.S. PATENT DOCUMENTS

| | | | |
|---|---|---|---|
| 3,532,886 | 10/1970 | Kruger et al. | 340/933 |
| 3,685,012 | 8/1972 | Case et al. . | |
| 3,690,233 | 9/1972 | Billingsley . | |
| 4,037,250 | 7/1977 | McGahan et al. . | |
| 4,080,629 | 3/1978 | Hammond et al. . | |
| 4,173,010 | 10/1979 | Hoffmann | 340/936 |
| 4,591,823 | 5/1986 | Horvat . | |
| 4,651,144 | 3/1987 | Pagano . | |
| 4,774,571 | 9/1988 | Mehdipour et al. . | |
| 4,847,772 | 7/1989 | Michalopoulos et al. . | |
| 4,866,438 | 9/1989 | Knisch . | |
| 4,887,080 | 12/1989 | Gross . | |

(List continued on next page.)

FOREIGN PATENT DOCUMENTS

WO93/19441 of 0000 WIPO .

OTHER PUBLICATIONS

Monitron International product brochure entitled "Monitron International", p. 10, article on Number Plate Recognition.
Texas Transportion Institute website summary article entitled "Houston TranStar" at http://traffic.tamu.edu.
Lynn et al, Final Report: Automated Speed Enforcement Pilot Project . . . pp. 1–12 , Nov. '92.
Excite Internet search results, "traffic enforcement"and "automatic" conducted Dec. 14, 1997, third hit; Summary (article not available).
City of Los Angeles, "Automated Traffic Surveillance and Control", "1992 Winner", 1992.
Dr.William Sowell, "It's all in the pixels—A look at the evolution of video detection", for Peek Traffic pp. 1–4.
Pearpoint product brochure entitled "Vehicle License Plate Video Capture System".
Driver Safety Systems; web page at http://www.dss.co.il and subpages; printed from Internet on Dec. 14, 1997 14 pages.

*Primary Examiner*—Jeffery A. Hofsass
*Assistant Examiner*—Anh La
*Attorney, Agent, or Firm*—John Moetteli

[57] ABSTRACT

A traffic law enforcement system having two or more enforcement units and at least one central computer connected via network devices. The enforcement units are spaced apart a given distance and each has a license plate reader. The central computer receives inputs from two not necessarily adjacent enforcement units, including identifying indicia, such as license plate numbers of passing vehicles. The enforcement units and the central computer cooperate to calculate an average velocity of a vehicle which passes between two not necessarily adjacent enforcement units by using the inputs of a) minimum-travel-time-drivable distance between enforcement units which transmitted matching identifying indicia, b) posted speed limit data between enforcement units which transmitted matching license plate numbers, and c) time lapsed between the transmission of the matching identifying indicia to the central computer. Optionally, after a predetermined amount of time, vehicle information which do not indicate violations, is erased.

6 Claims, 9 Drawing Sheets

U.S. PATENT DOCUMENTS 4,902,889 2/1990 Sodi .
5,041,828 8/1991 Loeven .
5,317,311 5/1994 Martell et al. .
5,381,155 1/1995 Gerber ..... 340/936
5,448,484 9/1995 Bullock .
5,515,042 5/1996 Nelson .
5,530,441 6/1996 Takatou et al. .
5,563,590 10/1996 Mira ..... 340/936
5,590,217 12/1996 Toyama .
5,663,720 9/1997 Weissman .
5,734,337 3/1998 Kupersmit ..... 340/936
5,742,699 4/1998 Adkins et al. ..... 382/107
5,771,485 6/1998 Echigo ..... 340/936
5,801,943 9/1998 Nasburg .
5,809,161 9/1998 Auty et al. .

600

Table

| Comb. | Seg. no.\ dist. miles | speed limit in seg. | Seg. no.\ dist. miles | speed limit in seg. | Seg. no.\, dist. miles | speed limit in seg. | Dt miles | AMV (mph) |
|---|---|---|---|---|---|---|---|---|
| X1-X2 | 612\2 | 55 | | | | | 2 | 55 |
| X1-X3 | 612\2 | 55 | 614\3 | 45 | | | 5 | 48.5 |
| X1-X4 | 612\2 | 55 | 614\3 | 45 | 616\2 | 30 | 7 | 41.7 |
| X1-X5 | 620\3 | 10 | | | | | 3 | 10 |
| X2-X3 | 614\3 | 45 | | | | | 3 | 45 |
| X2-X4 | 614\3 | 45 | 616\2 | 30 | | | 5 | 37.6 |
| X2-X5 | 612\2 | 55 | 620\3 | 10 | | | 5 | 14.9 |
| X3-X4 | 616\2 | 30 | | | | | 2 | 30 |
| X3-X5 | 616\2 | 30 | 618\4 | 45 | | | 6 | 39 |
| X4-X5 | 618\4 | 45 | | | | | 4 | 45 |

700

Fig. 7

TRAFFIC LAW ENFORCEMENT SYSTEM

This is a continuation-in-part application of PCT application No. PCT/US97/18871, filed Oct. 28, 1997, the contents of which are incorporated herein by reference.

BACKGROUND OF THE INVENTION

This invention relates to traffic enforcement devices for use in enforcing traffic ordinances. More specifically, this invention relates to remotely operated enforcement systems having velocity determining and recording means.

In the United States, the prevalent method of enforcing traffic laws is to utilize police officers who patrol the streets in police patrol cars in an effort to pursue, detain and ticket or warn those persons who they observe to have violated the traffic laws. Typically, an officer will monitor vehicle velocity by using a wide variety of alternative means to monitor such velocity, including the use of a radar gun (e.g., a Doppler radar), a laser beam, or sensing toils or pads placed on the roadway, as in U.S. Pat. No. 4,234,923. These alternative means require the involvement of at least one police officer, and a patrol vehicle including all equipment normally supplied a patrol vehicle. These resources are costly and are of limited supply. Further, the step of pursuing and detaining traffic ordinance violators can be dangerous to the police officer and the public at large. For example, an irate driver threatens the officer, the driver makes an effort to evade the officer, initiating a high speed chase, or the driver pulls over in an unsafe area on the highway, thus subjecting others to an unnecessary danger of collision.

Despite the dangers associated with the current methods of traffic ordinance enforcement, the benefits obtained outweigh the costs and dangers to the public. Proper enforcement results in the reduction in the number of traffic accidents and traffic fatalities, and a decrease in the costs to society of medical treatment and automotive and medical insurance. This was observed to have been the case when the national speed limit on interstate highways was reduced from 70 mph to 55 mph. In addition, the reduction of traffic accidents is highly correlated with a reduction in traffic congestion. When a patrol vehicle blocks even just one lane of a multi-lane highway, this may disproportionately decrease traffic through-flow, due to the need of accommodating merging traffic and due to a phenomenon commonly known as "rubber-necking" (the tendency of persons who notice an accident or accident scene to slow down in order to better observe the accident scene).

Traffic enforcement devices, which provide a means for enforcement of the traffic ordinances without the direct involvement of a police officer or a patrol vehicle, have been in use for some time in Europe and in other regions of the world. U.S. Pat. Nos. 4,866,438 and 5,066,950 describe remotely located devices which include a radar device and means of automatically triggering a high resolution photographic camera when a vehicle passes within its field of detection. These systems require matching of the license plate number read from a photograph taken by the camera with a number in a database of registered vehicles in the state, region or nation. Upon identification, a traffic citation is issued and mailed to the registered owner of the vehicle in a non-confrontational manner without utilizing a patrol vehicle or a police officer's time. Despite these advantages, because the location of the violation must be noted on the citation (if it is not readily apparent from the photograph taken by the device) and is almost always supplied to the driver, the public may soon become aware of the location of the devices. When this occurs, drivers will know that they must slow down at this location in order to avoid receiving a traffic citation. Although slowing traffic to safe limits is a purpose of these prior art devices, this purpose will only partly be accomplished (i.e., persons will obey the traffic ordinances within the field of detection of the device). An effective system of such devices, capable of enforcing the traffic ordinances within an entire urban area, will be prohibitively expensive, because the urban area which is to be monitored must have a sufficient number of these units to ensure that a majority of the streets in the area are, in fact, being monitored (i.e., in order to minimize or eliminate any streets on which drivers having knowledge of each enforcement unit location can violate the traffic ordinances with impunity). Using only conventional technology, this mandates that an effective system of enforcement be comprised of a large number of these units which essentially blanket the urban area. Because each unit consists of relatively expensive and technologically sophisticated components, a system which blankets all drivable streets and highways is prohibitively expensive.

Therefore, what is needed is a system which enables effective, low cost enforcement of traffic ordinances without requiring that a police officer and patrol vehicle pursue and detain suspected traffic ordinance violators. Further, what is needed is a system which cannot be defeated by radar jamming or by the driver merely slowing down within range of an enforcement unit.

SUMMARY OF THE INVENTION

The foregoing problems are solved and a technical advantage is achieved by the provision of a traffic law enforcement system having two or more enforcement units and at least one central computer connected via network devices. The enforcement units are spaced apart a given distance and each has a license plate reader. The central computer receives inputs from the enforcement units. The enforcement units and the central computer cooperate to calculate an average velocity of a vehicle which passes between enforcement units by using the inputs of a) drivable distance between enforcement units which transmitted matching license plate numbers, b) posted speed limit data between enforcement units which transmitted matching license plate numbers, and c) time lapsed between the transmission of the matching license plate numbers to the central computer.

In another feature of the invention, a signal is sent to the enforcement unit which was last in time to send the matching license plate number. The signal causes the enforcement unit to capture and store evidentiar data (e.g., an image) of the vehicle having the matching license plate number for enforcement purposes.

In another feature of the invention, the system may include more that two enforcement units which cooperate with each other and the central computer to identify a vehicle whose average velocity is calculated across paths between at least three enforcement units. This permits the capture of at least two images of the vehicle for evidentiary purposes.

An advantage achieved with the present invention is that a system is provided which enables effective, low cost enforcement of traffic ordinances without requiring that a police officer and patrol vehicle pursue and detain suspected traffic ordinance violators.

Another advantage of the present invention is that vehicles associated with wanted persons may be identified and the police department may be subsequently notified.

Another advantage of the present invention is that the time in which the license plate numbers are held in a database need only be a short period. This is due to the fact that only those vehicles which quickly pass through or within an urban area generate an average velocity calculation which exceeds the posted limits between the two points. Thus, all license plate data may automatically be erased after only a few minutes. This will enable privacy concerns to be considered while, at the same time, maintaining an effective enforcement system.

Another advantage of the present invention is that enforcement units need only be placed on the outskirts of opposite ends of a city, thus only measuring the speed, and potentially ticketing those vehicles whose drivers use the city's roads, but do not pay city taxes. This permits a more politically acceptable application of the system for enforcement purposes.

Still another advantage is that decoy units may be randomly replaced with enforcement units and vice versa, thus permitting the system to provide a deterrent effect while simplifying the system by mixing simply constructed decoy units with more complicated enforcement units.

BRIEF DESCRIPTION OF THE DRAWINGS

Other objects and advantages of this invention will become readily apparent as the same is better understood by reference to the following detailed description when considered in connection with the accompanying drawings wherein:

FIG. 7 is a lookup table used in the system of the present invention.

DETAILED DESCRIPTION OF THE PREFERRED EMBODIMENT

Figure 1:
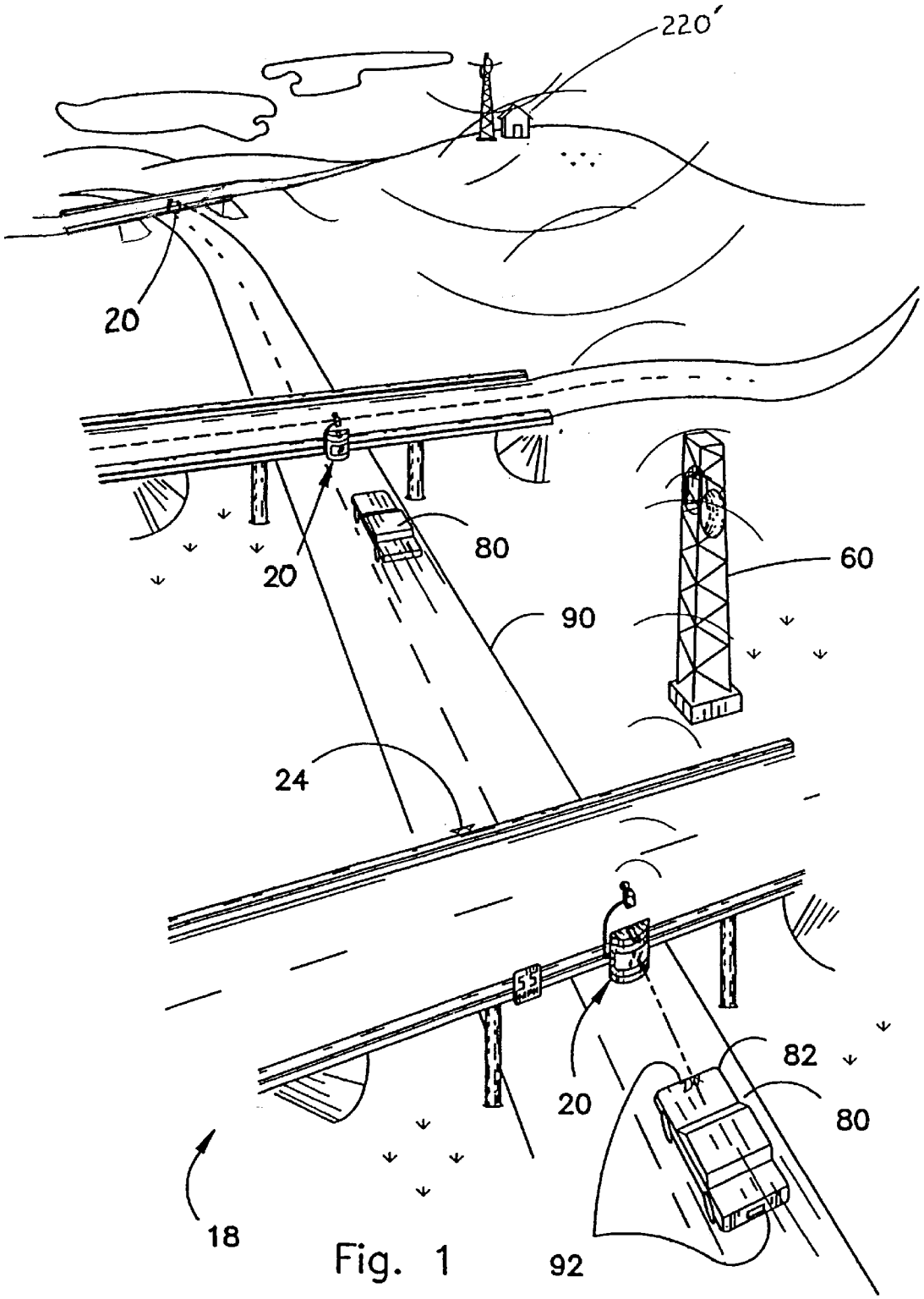
FIG. 1 is a landscape view showing the basic components of the system of the present invention.

Now referring to FIG. 1, in which is shown a preferred embodiment of the system of the present invention, the traffic law enforcement system 18 includes at least two enforcement units 20, optional decoy units 22 (shown in FIG. 3), and a receiving interface 24 onto which either the enforcement unit or any decoy unit 22 may be engaged.

In order to permit identification of a potential violator, identifying indicia 82 is placed on a visible portion of an automobile 80, such indicia including a conventional license plate number, inspection sticker, registration sticker, or alphanumeric symbols placed on the surface of the automobile in which the characters are large enough to be read by a Number Plate Recognition (described in more detail below).

The vehicle speed determination and evidence capturing capability of the traffic law enforcement system 18, combined with the fact that motor vehicles 80 for use on freeways 90 have identifying license plates 92 with alphanumeric symbols of a size sufficient to be captured in a legible form, enables remote enforcement of the speed limits by ticketing or warning the registered owner of any vehicle found to have exceeded the posted speed limits.

Figures 2A, 2B:
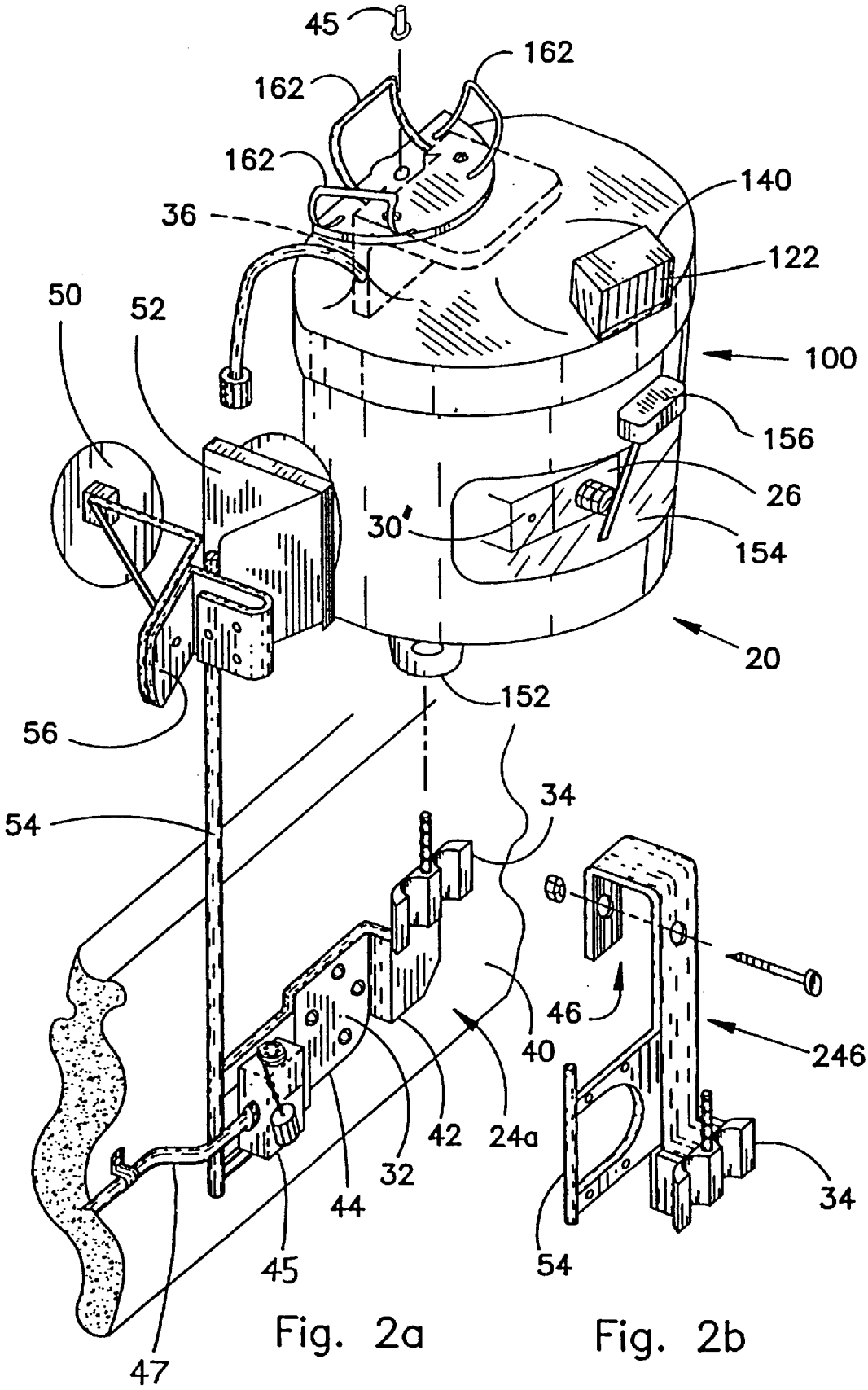
FIG. 2*a* is a perspective view of an enforcement unit and a mounting structure of the system of the present invention.
FIG. 2*b* is a perspective view of an alternate embodiment of the mounting structure of the system of the present invention.
Figure 3:
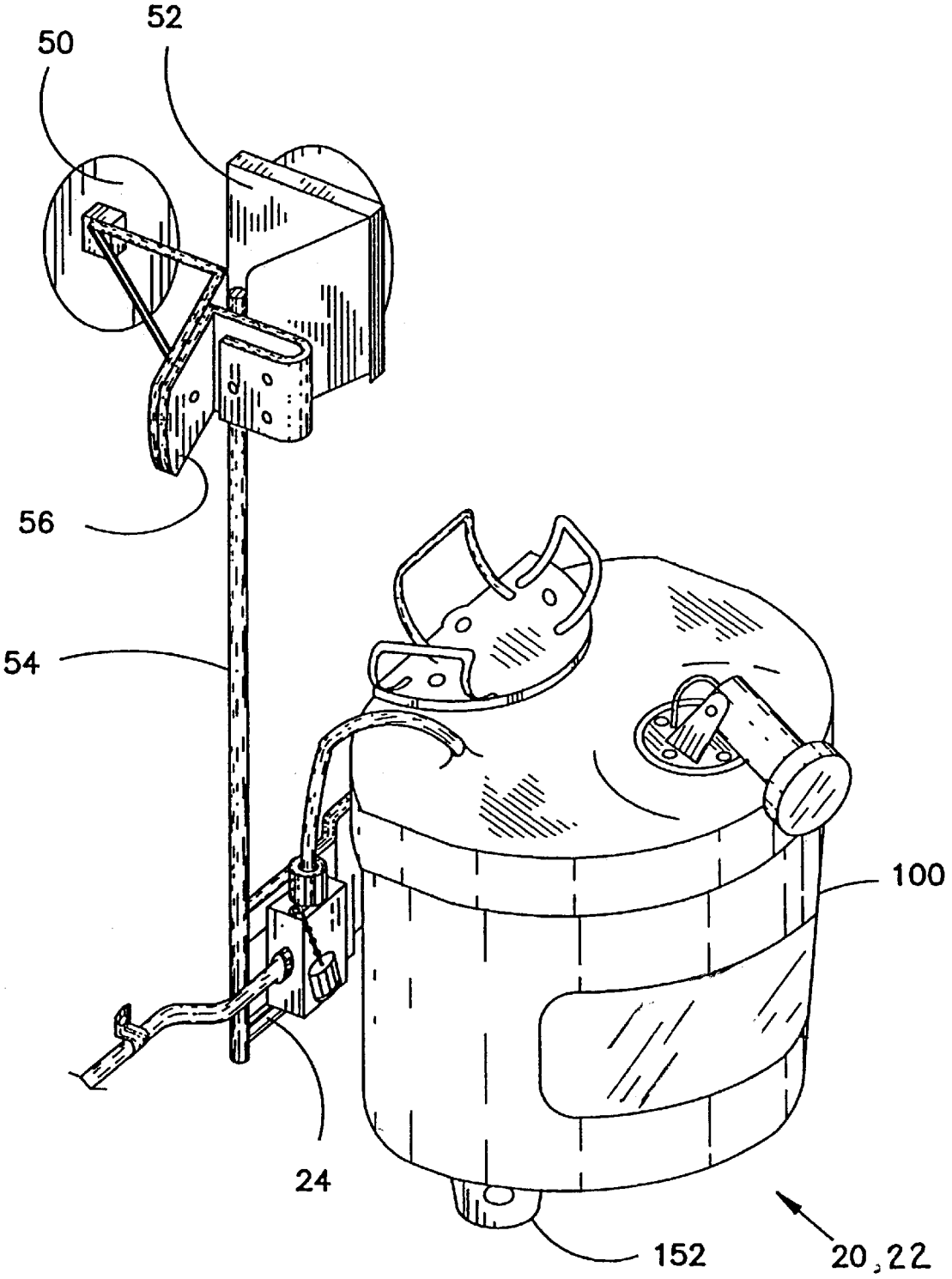
FIG. 3 is a perspective view of either an enforcement unit or a decoy unit of the present invention.

Now referring to FIGS. 2*a*, 2*b*, and 3, the enforcement unit 20 includes a mating interface 36, shown in dashed lines, a housing 100 and a multi-functional license Number Plate Recognition device ("NRD") 30'. The receiving interface 24*a* includes a mounting portion 32 and an interface end 34 which releasably engages with the mating interface 36 on the enforcement units 20 or the decoy unit 22. The mounting portion 32 is specially fabricated to interface with and securely mount to a structure 40, adjacent to or above a highway or street, using a locking device 43 to prevent tampering. The receiving interface 24*a* and an alternate interface 24*b* enables secure, precise and repeatable attachment of an enforcement unit 20 or decoy unit 22 to various types of structures, such as a concrete railing, a sidewall of an overpass, or a dedicated support structure. A power and/or communications junction box 45, and corresponding cable conduit 47 attach to the structure 40. A power and/or communications cable 49 connects to the junction box 45.

The receiving interface 24*a* and the mating interface 36, enable routine relocation of the enforcement unit 20 to other geographic locations, and/or the substitution of a simply constructed decoy unit 22 in the place of the enforcement unit, thus increasing the difficulty of a driver discriminating between active enforcement units and decoy units, decreasing the number of relatively complicated active enforcement units required in the system (by substituting most of them for simply constructed decoy units), and, consequently, decreasing the complexity and cost of the entire system 18.

In another configuration, the receiving interface 24*a* or 24*b* includes a mounting frame 42 which is permanently affixed to the structure 40 using conventional fastening devices, such as bolts 44. In the alternate configuration of the receiving interface 24*b*, the mounting portion 32 has the form of a hanger having a clamping end 46 which affixes to a highway structure 40, and an interface end 34 which releasably engages with either the enforcement 20 or decoy unit 22.

The housing 100 of the enforcement unit 20 further includes a panoramic portal 154 extending through an arc on the housing, the arc being of an angular magnitude sufficient to enable the retargeting of the video camera 26 within a range of angular increments which permit easy adjustment of the targeting of the camera. In case of a multi-lane highway or thoroughfare 90, an enforcement unit 20 is dedicated to each lane of the highway or street in order to nimize the possibility of a driver avoiding the enforcement unit. Thus, if there are three lanes to the highway 90, all lanes directing traffic in a single direction, three enforcement units 20 are positioned over each lane. Such an arrangement further reduces the processing burden on each enforcement unit 20.

The wiper device 156 optionally mounts above the portal 154. The wiper device 156 includes a moisture or water-activated sensor 160 which causes the wiper to wipe moisture from the portal 154 at predetermined intervals.

The housing 100 further includes handles 162 mounted on the housing to facilitate the process of substituting enforcement units 20 for decoy units 22 and vice versa.

Optionally, built-in blowers 164 and a heater 166, together with a thermostat and circuit 170 may be provided to avoid temperature extremes beyond the operational limits of the enforcement unit 20.

A receiving dish 50 and a transmitting device 52 are affixed to the mounting frame 42 of the receiving interface 24*a* via a stanchion 54 and a mounting gimbal assembly 56, and are undisturbed when the enforcement unit 20 or the decoy unit 22 is removed from the receiving interface 24*a*. This permits one-time targeting of the receiver 50 and the transmitter 52 to its associated line-of-sight cell, hub or router 60. The subsequent interchange of enforcement units 20 does not disturb the targeting of the receiver 50 or the transmitter 52.

Figure 4A:
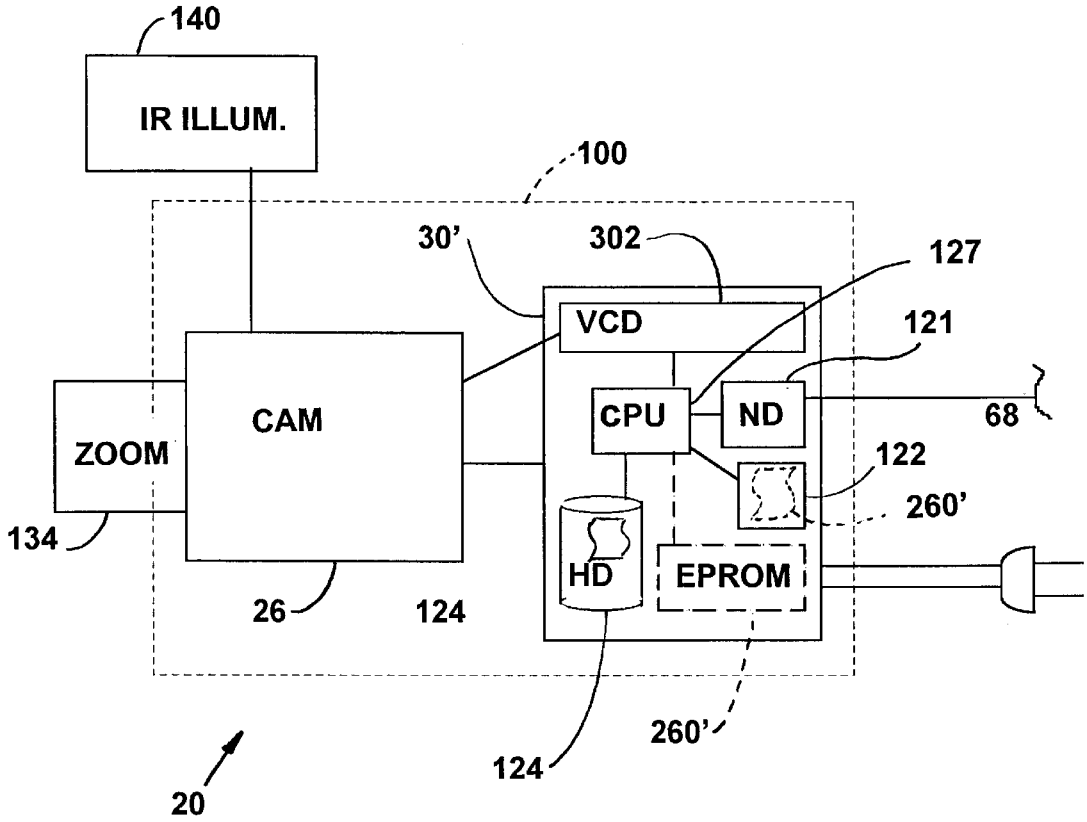
FIG. 4*a* is a schematic view of an enforcement unit of the present invention.

Referring now to FIG. 4*a* in which a schematic of an enforcement unit 20 of the present invention is shown, the camera 26 is operably connected to the NRD 30'. The camera 26 and NRD 30' are enclosed within a housing 100. The camera 26 may be standard or include IR illumination 140, as well as features such as a zoom lens 134 and the capability of taking high-resolution video images. The NRD 30' includes a video capture device ("VCD") 302 connected to a computing device (essentially a PC) which includes RAM memory 122 for image processing, a hard disk ("HD") 124 for image and data storage including storage of pattern recognition software 260 (alternately, an EPROM 260' programmed with the pattern recognition software may substitute for the hard disk), a CPU 127, and a network device 121. The network device 121 (e.g., an RS232 serial port and dedicated data line, a modem, ethernet, radio or other wireless network device) capable of data transmission and reception, connects to the NRD 30' to permit near real-time transmission of signals to and from a central computer 350 (shown in FIG. 4*b*) at a command station 220 (shown in FIG. 4*b*). An NRD 30', suitable for this application, is available from such companies as Monitron International of Worcestershire, England. Under ideal conditions, the Monitron NRD 30' is able to reliably identify license plates on vehicles traveling from 0 to 100 or more mph at a distance of 60 or more meters. Further, the Monitron NRD 30' can handle traffic flow rates in excess of 100 vehicles per minute and can identify a license plate in less than one half second. However, performance of an NRD 30' can be easily tailored to the needs of the application through the appropriate selection of the individual components to make a custom NRD.

Figure 4B:
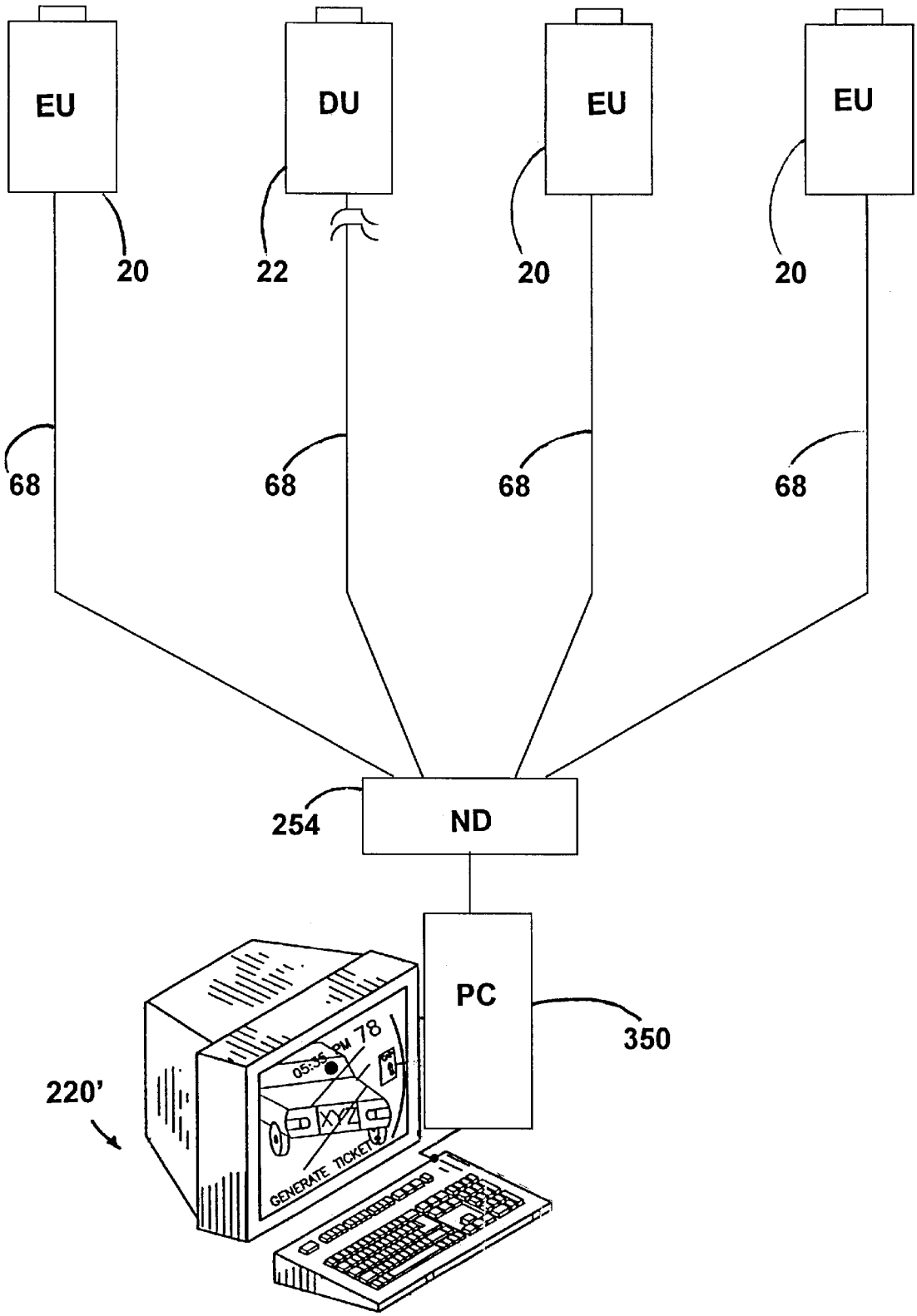
FIG. 4*b* is a schematic view of the system of the present invention.

Now referring to FIG. 4*b*, the system 18 of the invention is shown. Enforcement units 20 and, optionally, decoy units 22 are placed in strategic locations along traffic flow routes, typically within a metropolitan area 600 (shown in FIG. 6). The enforcement units 20 are connected via network lines 68 to a network device 254. The network device 254 connects to the central computer 350 at the command station 220. The enforcement units 20 transmit data in a data stream including license plate number data, time of transmission, and a location code in which the related data is separated by separators and unrelated data is separated by start bits.

The central computer 350 within the command station 220 is an IBM compatible computer having at least a "PENTIUM II" 233, or better, 32 MB of RAM memory, and a hard disk with 4 GB of available storage. Also, the central computer 350 is loaded with "WINDOWS" 3.11 or better ("WINDOWS 95" OR "WINDOWS NT" can be used), a specially modified version of the above or suitable substitute (such as a "UNIX DERIVED" operating system).

Referring again to FIG. 4*a*, any images captured by the VCD 302 which were stored during the course of a day are transmitted across the communications path 68 between the command station 220 and the enforcement unit 20 at an appropriate time, such as during a period of low use or low noise (e.g., in the nighttime hours). Note that the capacity of the HD 124 can be maximized and the data transmission rate improved using JPEG image compression, for example. If the communications path 68 is a telephone line, then the image 108 may be transmitted via modem to the central computer 350, the central computer using the corresponding network device 254 to answer and communicate with the computer device at the enforcement unit 20. This enables real-time transmission of the lower resolution video image, and transmission of larger high-resolution image files during off-peak hours via a telephone line. However, whenever the communications link permits, the transfer should take place immediately over the network line via a comlink.

It should be understood that the communications path described in the embodiments above may be comprised of any of a number of different paths, including UHF/VHF, microwave, cable, network line, telephone line, optical fiber, cellular wireless, ethernet, line-of-sight wireless, satellite, a laser link, or powerlines.

Where closed-circuit communications cable (e.g., a fiber-optic computer networking cable) provides the communications path between the enforcement unit and the command station, simpler equipment can be used.

The infrared illuminator 140 provides powerfuil infrared lighting that is invisible to the human eye, yet visible to the video camera, thus enabling the capturing of infrared images of a moving vehicle at night or day without startling or disturbing the driver. The illuminator 140 is mounted to the housing, and includes a built-in photocell which automatically turns the illuminator on at night and off at dawn. Built-in blowers are also provided to keep the illuminator cool. A suitable illuminator, in wide-angle and narrow angle versions is, part no. HAS-7698A, and HAS-7698B, respectively, available from Home Automation Systems (URL: http://www.techmall.com/smarthome/7690.html) or the P345 IR Illuminator Module from Pearpoint Inc. of Thousand Palms, Calif. In addition, the camera 26 may have an infrared filter.

Figure 5:
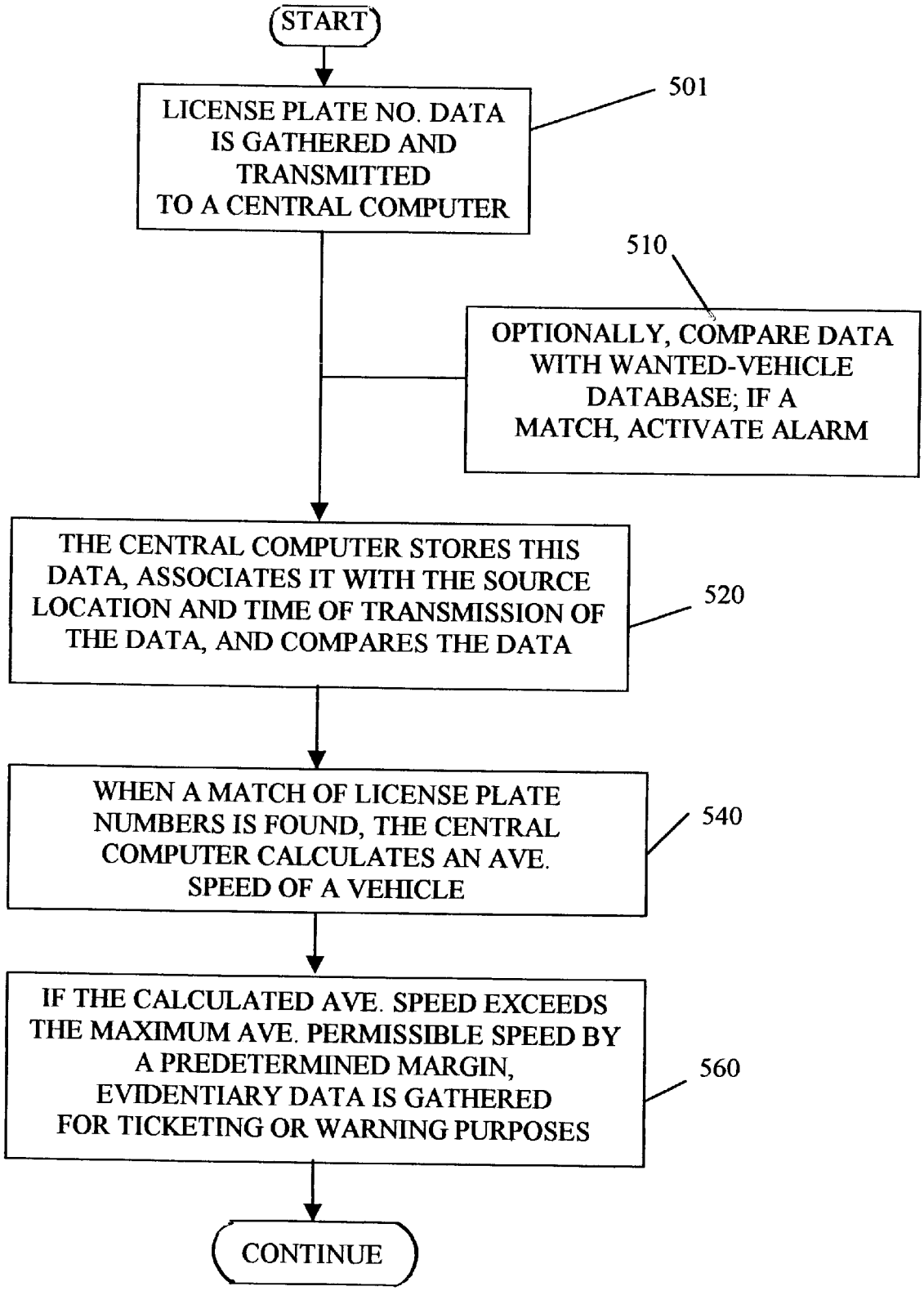
FIG. 5 is a flow diagram of a summary method of the present invention.

In a summary of the method of operation of the invention, as shown in FIG. 5, the traffic law enforcement system 18 executes four steps.

In a first step 500, the method gathers license plate number data and transmits such data to the central computer 350. The enforcement units 20 read license plate numbers from passing vehicles 80 at two or more locations and transmit the license plate numbers to the central computer 350.

In a second step 520, the central computer 350 associates a time of the transmission from the enforcement units 20 to the central computer and a location of the source of the license plate number in a manner which enables the central computer to recognize when a license plate number is received which matches another license plate number received earlier in time and within a predetermined maximum time period. The central computer 350 then accesses a data lookup table 700 (shown in FIG. 7). The table 700 includes i) in column 5, an estimation of a minimum drivable distance between the two locations, for example X1 and X2, of the enforcement units 20 which sent the matching license plate numbers, and ii) in column 6, an estimation of the maximum average permissible velocity between the two locations. This estimation is generated, at least indirectly, from speed limit data corresponding to road segments (612, 614, 616, 618 and 620 shown in FIG. 6) which defined the minimum drivable distance between the at least two locations X1 and X2.

In a third step 540, the central computer 350 calculates the average velocity of the vehicle 80 between the two locations and compares the maximum average permissible velocity with the average velocity of the vehicle 80.

In a fourth step 560, if the average speed of the vehicle exceeds by a predetermined margin the maximum average permissible velocity between the locations of the enforcement units 20, evidentiary information is stored for future retrieval (e.g., an image of the vehicle may optionally be captured for evidentiary purposes).

Figure 6:
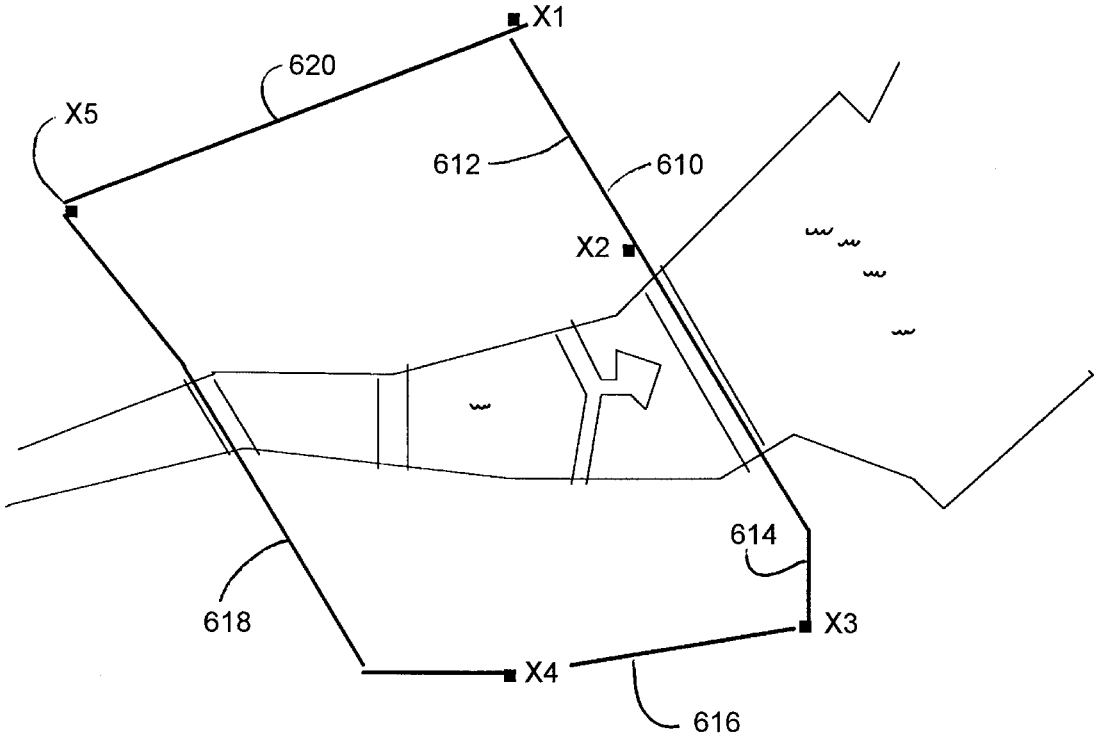
FIG. 6 is a representative map of a metropolitan area showing the locations of five enforcement units.

Referring now to FIG. 6, a representative map of a metropolitan area 600 is shown having five enforcement units at locations X1, X2, X3, X4 and X5 placed throughout the area. Known paved surfaces 610 such as highways, representing road segments 612, 614, 616, 618 and 620 between enforcement units 20, crisscross the metropolitan area 600.

Referring now to FIG. 7 in which is shown the lookup table 700, in column 1 of the table is a listing of all possible combinations of any two enforcement units 20 at locations X1, X2, X3, X4, and X5. The shortest paved surface distances from one enforcement unit 20 to another not necessarily adjacent enforcement unit is measured and stored in the table 700 in column 5, in a row corresponding to the combination of the two enforcement units which transmitted the matching license plate numbers. In order to generate the data in column 6 of the table 700, the segment lengths and posted speed limits along each segment 612, 614, 616, 618 and 620 are noted in columns 2–4 for each segment. An average maximum permissible velocity ("AMV") is calculated by an appropriate means. One such means is through the use of the below formula:

$$AMV = \frac{Dt}{((D1/PS1) + (D2/PS2) + (D3/PS3) + \ldots + (Dn/PSn))}$$

in velocity units such as mph, where:

AMV=average maximum permissible velocity between the two locations;

Dt=total distance between the two locations;

Dn=distance of the "nth" segment; and

PSn=the posted speed limit for the "nth" segment;

or empirically, using the following relationship:

AMV=Dt/EMT, where:

EMT=empirically measured time to drive the distance Dt, determined at maximum posted speed limits and for a safe rate of acceleration.

The average maximum permissible velocity AMV for every possible combination of enforcement unit location is recorded in column 6 of the table 700, in the same row as the associated total distance and the combination of the two enforcement units which sent the matching license plate numbers.

Figure 8:
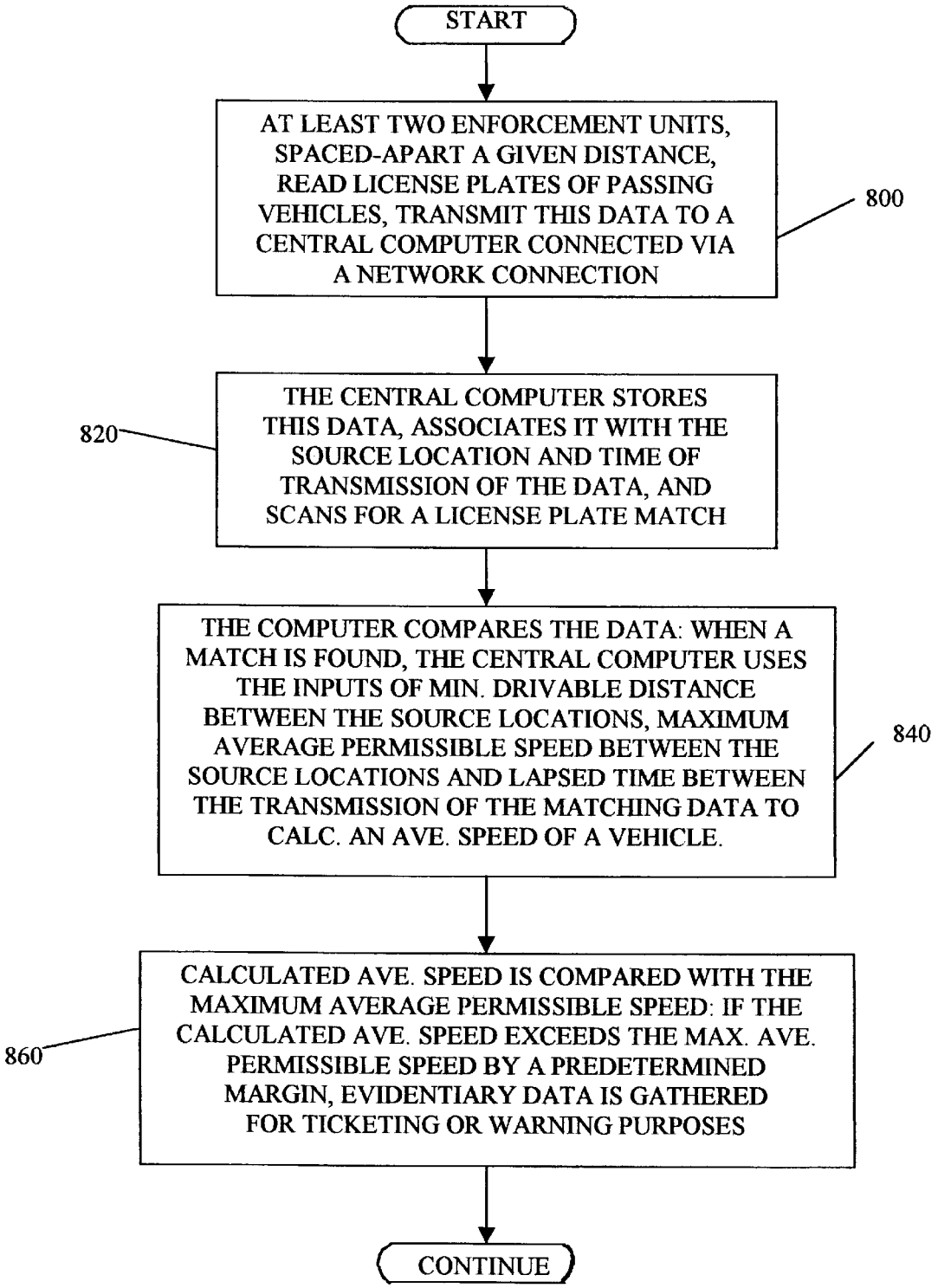
FIG. 8 is a flowchart of the method of the present invention.

The method of the invention, shown in more detail in FIG. 8, includes the following steps.

In a first step 800, data is gathered and transmitted to the central computer 350 for analysis. This first step 800 is made up of three substeps. In a first substep, using known license plate number recognition equipment and techniques (described in more detail above), enforcement units 20 routinely read license plates of passing vehicles 80, whether or not they are exceeding the posted speed limit. In a second substep, the location, time, and a license plate number of each vehicle 80 is transmitted to the command station 220 and stored in a license number database for a certain period of time. In a third substep, the license number database is scanned and all license plate number inputs which do not indicate violations having an associated time which has been in storage longer than a predetermined period of time are deleted from the license number database. This predetermined period of time need be only a few minutes (e.g., 10 minutes), due to the fact that only those vehicles 80 which pass quickly through or within a metropolitan area 600 generate an average velocity calculation which exceeds the posted limits between the locations of the enforcement units 20 which sent the matching license plate number data.

Note that when the predetermined time period mentioned above is short, data inputs are deleted in a certain period (of a length related to the time between implementations of the third substep to step 800 above) which may also be short. Publication to the general public that such data will be quickly erased from the license number database (unless a violation of the average maximum permissible velocity is exceeded by a predetermined margin or the vehicle is believed to be a stolen vehicle or registered to a wanted felon) will tend to satisfy concerns of persons that such gathered data might be permanently stored in order for enforcement authorities to learn of the travel and driving habits of individual persons, in violation of their rights of privacy. After this predetermined period passes, all license plate data which do not indicate violations may automatically be erased.

In a second step 820, the license number database is scanned for trigger information. This second step 820 is made up of three substeps. In a first substep, a subroutine operating on the central computer 350 at the command station 220 reads the input license plate numbers and continuously compares them with other license plate numbers previously received in the license number database. In a second substep, when the subroutine reads the same license plate number, the subroutine either proceeds to the next substep or initiates the sending of a signal from the command station 220' to the enforcement unit 20, the signal causing the capture of evidence (such as an image) related to the vehicle 80 such as in the case that the vehicle is indicated as having been stolen or registered to a wanted felon. In a third substep, the time and location data associated with the matching license plate numbers is accessed.

In a third step 840, the average speed of the vehicle 80 is calculated. The subroutine calculates the time difference Td and accesses data in column 5 of the table 700 on the minimum paved distance Dt between the two enforcement units 20 which read the matching license plate numbers in order to calculate an average velocity of the vehicle 80 associated with the license plates. This average velocity is subtracted from the average maximum permissible velocity ("AMV") obtained from column 6 of the table 700. The following formula may be used:

EV=((Dt/Td)−AMV) in velocity units where:

EV is velocity in excess of the AMV;

Negative values of AMV are ignored as such represent a vehicle traveling less than the AMV.

In a fourth step 860, in the event of a violation of the traffic ordinances, evidentiary data is gathered to support subsequent ticketing or a warning notice. This fourth step 860 includes four substeps. In a first substep, if this average velocity exceeds the average velocity of a hypothetical vehicle 80 passing along the shortest paved path between the enforcement units 20, then the command station 220 immediately sends a signal along a communications path 68 to the enforcement unit 20 which sent the most recent signal, instructing the computer device in the enforcement unit to capture the image of the vehicle (if this has not already been done) and to either store the image on the HD 124 of the computing device in the enforcement unit for later retrieval, or to immediately transmit the captured image of the vehicle 80 to the central computer 350 for storage there.

The output which would be obtained is used to support any subsequently issued ticket or warning letter. Such output might contain the following information:

time of violation\license plate number\speed in excess of AMV\AMV

Of course, this information would likely best be provided with an attached video image clearly showing the face of the driver.

Note that the image could optionally be captured on the central computer 350 at the command station 220', were the video image transmitted real time to the central computer, thus eliminating the need of a NRD 30' in each enforcement unit 20. Note also that no image need be captured at all. It may be politically more acceptable to rely purely on the evidentiary value of a print out of the license number and associated data because such may be less likely to violate the privacy interests of drivers. In a second substep of the fourth step 860, the image, if captured, may be stored on the hard disk (not shown) of the central computer 350 for use in subsequent ticketing or to support a warning. Such image may also be stored in the HD 124' of the computer device in the enforcement unit 20 and then, at a more convenient time, transferred via modem, for example, to the command station 220. In third substep, the earlier transmitted license plate number and associated data (such as location and time of transmission) are deleted from the license number database and the enforcement unit 20 injects a new signal into the data stream of license plate numbers and associated data being transmitted to the central computer 350. This new signal is stored in the license number database which includes the license plate number, an associated location and a new time, together with a flag associating the data with the recently stored or captured evidentiary data (such as a captured image). The flag may constitute the file name of the captured and stored video image. Such evidentiary data, including associated data such as time, location and license number, constitutes the flagged data as referred to hereinafter.

In a fourth substep, when the central computer 350 recognizes another license plate number match with the flagged data, the match resulting from data sent from a third enforcement unit 20, then the method returns to the third step 840, and continues as described above. However, if a velocity associated with the flagged data exceeds the AMV between the two locations by a predetermined amount, any resulting second set of evidentiary data (e.g., an image) is stored in association with the earlier captured evidentiary data such that an operator can easily locate and associate the data for enforcement purposes. In addition, enforcement authorities now can choose which violation they would prefer to prosecute the registrant of the vehicle 80 for, depending on the quality of the captured evidentiary data and the excess velocity of the vehicle at the time of capture. Enforcement authorities and the public may prefer enforcement based on the second set of captured evidentiary data (particularly when such data includes images) and calculated average speed because of the better evidentiary quality of being able to associate the captured images at each time and location measuring point. This increases the likelihood that any resulting ticket will be legally enforceable.

In another embodiment of the invention, shown as step 510 in FIG. 5, the license plate data in the license number database is compared with license numbers in a wanted-vehicle database (not shown). The license numbers in the wanted-vehicle database are of vehicles which enforcement authorities have previously identified as vehicles of interest for further investigation. When a match is found, the license number and time and location data are sent to enforcement authorities for further action. It is desirable in such instances that a match trigger an alarm in order to improve the response time of enforcement authorities. Such may be accomplished by using a dial-back on alarm condition feature, available from Monitron International of Worcestershire, England.

In an advantage of the invention, the measuring of an average velocity between relatively distant points discourages acceleration of a vehicle 80 between enforcement units 20, and then slowing down when a driver of the vehicle believes he is within their enforcement range. Thus drivers of vehicles 80 are less likely to be able to defeat the traffic law enforcement system 18 of the invention.

An advantage achieved with the present invention is that a system is provided which enables effective, low cost enforcement of traffic ordinances without requiring that a police officer and patrol vehicle pursue and detain suspected traffic ordinance violators.

Another advantage of the present invention is that vehicles 80 associated with wanted persons may be identified and the enforcement authorities, such as the police department, may be subsequently notified.

Another advantage of the present invention is that the time in which the identifying indicia 82 is held in storage need only be a short period. This will enable privacy concerns to be considered while, at the same time, maintaining an effective enforcement system 18.

Another advantage of the present invention is that enforcement units 20 may be placed only on the outskirts of opposite ends of a city, thus only measuring the speed, and potentially ticketing those vehicles which use the city's roads, but do not pay city taxes. This permits a more politically acceptable application of the system 18 because it helps ensure that those who use the city's roads indirectly pay their share of the costs of maintaining such roads.

Another advantage is that decoy units 22 may be randomly replaced with enforcement units 20 and vice versa, thus permitting the system 18 to provide a deterrent effect while simplifiing the system through mixing simply constructed decoy units with more complicated enforcement units.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

Industrial Applicability

The invention is applicable industrially as a means of reducing the velocity of drivers to safe limits while enabling more effective and safer enforcement of the traffic ordinances (by requiring less police interaction and the dedication of fewer police resources, such as police cars and related enforcement equipment). Such a system should play an important role in permitting municipalities to dedicate police resources to the enforcement of more serious criminal laws, or, alternately, to reduce the municipalities' traffic law enforcement costs.

What is claimed is:

1. A traffic law enforcement system wherein at least two enforcement units having identifying indicia readers are spaced apart a given distance;

wherein at least one central computer receives inputs, including identifying indicia of vehicles which pass the identifying indicia readers, from the at least two enforcement units;

wherein the at least two enforcement units and the at least one central computer cooperate to calculate an average velocity of a vehicle which passes between the at least two enforcement units; and wherein within a certain amount of time, the identifying indicia which does not indicate a violation are deleted from memory.

2. The system of claim 1 further comprising at least one decoy unit and attachment means which enable an enforcement unit to be replaced by a decoy unit and vice versa.

3. A traffic law enforcement system wherein at least two enforcement units having identifying indicia readers are spaced apart a given distance;

wherein at least one central computer receives inputs, including identifying indicia of vehicles which pass the identifying indicia readers, from the at least two enforcement units;

wherein the at least two enforcement units and the at least one central computer cooperate to calculate an average velocity of a vehicle which passes between the at least two enforcement units, wherein at least three enforcement units cooperate with the at least one central computer to identify a vehicle whose average velocity is calculated across the path of the at least three enforcement units and in which at least two images of the vehicle are recorded at different locations for evidentiary purposes; and wherein after a predetermined amount of time, the identifying indicia which does not indicate a violation are deleted from memory.

4. A traffic law enforcement system wherein at least two enforcement units having identifying indicia readers are spaced apart a given distance;

wherein at least one central computer receives inputs, including identifying indicia of vehicles which pass the identifying indicia readers, from the at least two enforcement units;

wherein the at least two enforcement units and the at least one central computer cooperate to calculate an average velocity of a vehicle which passes between the at least two enforcement units, wherein at least three enforcement units cooperate with the at least one central computer to identify a vehicle whose average velocity is calculated across the path of the at least three enforcement units and in which at least two images of the vehicle are recorded at different locations for evidentiary purposes; and wherein:

the system stores identifying indicia and place and time information into a central database until a match is found within a certain amount of time, and, when a match indicating a violation is found, the system captures and stores a graphical image and associated information, and then reinjects identifying indicia data into the central database together with an associated flag which points to the captured video image of the first match so that a subsequent violation can be associated with a prior violation.

5. A traffic law enforcement system having at least two enforcement units at least two locations and a central computer, wherein the at least two enforcement units read identifying indicia from passing vehicles at the at least two locations and transmit at least the identifying indicia to the central computer; and wherein the central computer;

a) associates a time of the transmission and a location of the source of the identifying indicia such that when the central computer redcognizes that an identifying indicia was received which matches another identifying indicia received earlier in time and within a certain period of time, the central computer calculates the average speed of an alleged vehicle which passed between the at least two locations, compares the maximum average permissible velocity with the average velocity of the vehicle, and determines whether the vehicle exceeded the maximum average permissible velocity between the at least two locations; and wherein after a predetermined amount of time, the identifying indicia which does not indicate a violation are deleted from memory.

6. A traffic law enforcement system wherein at least two enforcement units having identifying indicia readers are spaced apart a given distance;

wherein at least one central computer receives inputs, including identifying indicia of vehicles which pass the identifying indicia readers, from the at least two enforcement units;

wherein the at least two enforcement units and the at least one central computer cooperate to calculate an average velocity of a vehicle which passes between the at least two enforcement units and, wherein, after a predetermined amount of time, the identifying indicia which do not indicate a violation are deleted from memory.

* * * * *

US006121898C1

(12) EX PARTE REEXAMINATION CERTIFICATE (9478th)

United States Patent
Moetteli

(10) Number: US 6,121,898 C1
(45) Certificate Issued: Jan. 14, 2013

(54) TRAFFIC LAW ENFORCEMENT SYSTEM

(76) Inventor: John B. Moetteli, Geneva (CH)

Reexamination Request:
No. 90/011,381, Dec. 9, 2010

Reexamination Certificate for:

| | |
|---|---|
| Patent No.: | **6,121,898** |
| Issued: | **Sep. 19, 2000** |
| Appl. No.: | **09/047,272** |
| Filed: | **Mar. 24, 1998** |

Related U.S. Application Data

(63) Continuation of application No. PCT/US97/18871, filed on Oct. 28, 1997.

(51) Int. Cl.
*G08G 1/01* (2006.01)

(52) U.S. Cl. ..... 340/933; 340/905; 340/936; 348/149

(58) Field of Classification Search ..... None
See application file for complete search history.

(56) References Cited

To view the complete listing of prior art documents cited during the proceeding for Reexamination Control Number 90/011,381, please refer to the USPTO's public Patent Application Information Retrieval (PAIR) system under the Display References tab.

*Primary Examiner* — Mark Sager

(57) ABSTRACT

A traffic law enforcement system having two or more enforcement units and at least one central computer connected via network devices. The enforcement units are spaced apart a given distance and each has a license plate reader. The central computer receives inputs from two not necessarily adjacent enforcement units, including identifying indicia, such as license plate numbers of passing vehicles. The enforcement units and the central computer cooperate to calculate an average velocity of a vehicle which passes between two not necessarily adjacent enforcement units by using the inputs of a) minimum-travel-time-drivable distance between enforcement units which transmitted matching identifying indicia, b) posted speed limit data between enforcement units which transmitted matching license plate numbers, and c) time lapsed between the transmission of the matching identifying indicia to the central computer. Optionally, after a predetermined amount of time, vehicle information which do not indicate violations, is erased.

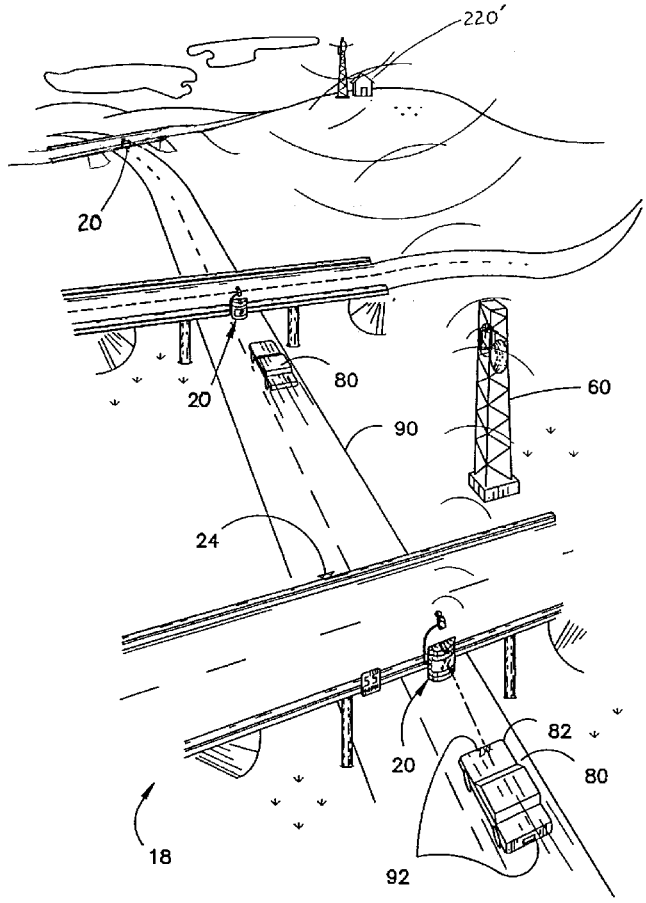

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-6 are cancelled.

* * * * *